US006293071B1

(12) United States Patent
Konstantinidis

(10) Patent No.: US 6,293,071 B1
(45) Date of Patent: Sep. 25, 2001

(54) ANTISEISMIC SPIRAL STIRRUPS FOR REINFORCEMENT OF LOAD BEARING STRUCTURAL ELEMENTS

(76) Inventor: Apostolos Konstantinidis, Alektoros 7, 116 32 Athens (GR)

( * ) Notice: Subject to any disclaimer, the term of this patent is extended or adjusted under 35 U.S.C. 154(b) by 0 days.

(21) Appl. No.: 09/331,805

(22) PCT Filed: Dec. 31, 1997

(86) PCT No.: PCT/GR97/00043

§ 371 Date: Jun. 25, 1999

§ 102(e) Date: Jun. 25, 1999

(87) PCT Pub. No.: WO98/29618

PCT Pub. Date: Jul. 9, 1998

(30) Foreign Application Priority Data

Jan. 3, 1997 (GR) ..... 970100003

(51) Int. Cl.[7] ..... E04C 5/06

(52) U.S. Cl. ..... 52/659; 52/660; 52/745.17

(58) Field of Search ..... 52/737.1, 737.6, 52/745.17, 745.19, 656.1, 659, 660

(56) References Cited

U.S. PATENT DOCUMENTS 3,882,905 * 5/1975 James ..... 140/92.1
4,150,475 * 4/1979 Bondpers ..... 29/469

* cited by examiner

*Primary Examiner*—Beth A. Stephan

(57) ABSTRACT

The present invention refers to stirrups for reinforcement of load bearing structural elements, and in particular for reinforcing concrete load bearing building elements, such as columns, shear walls, beams, slabs, footings, lintels, piles. The invention refers also to a method for reinforcing structural elements as well as to these elements. A stirrup for reinforcing load bearing elements according to the invention consists of a plurality of consecutive windings (7*a*, 7*b*) disposed along the longitudinal direction of the stirrup, so that the stirrup has a spiral form, whereby the windings of the stirrup form a plurality of discrete cages (5*a*, 5*b*) to house the main reinforcement bars (1*a*, 1*b*) of the load bearing element. The stirrups may be used for the reinforcement of load bearing elements of various cross sections such as orthogonal, T-shaped, L-shaped, Z-shaped etc.

14 Claims, 10 Drawing Sheets

Figure 3a
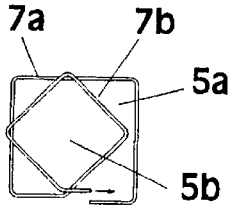
Figure 4a
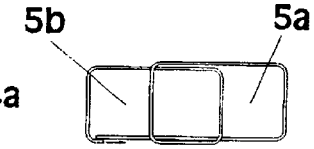
Figure 4b
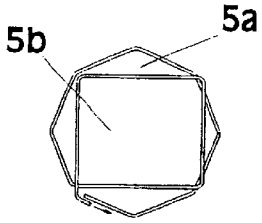
Figure 4c
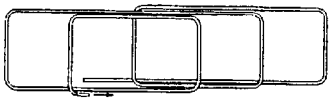
Figure 4d
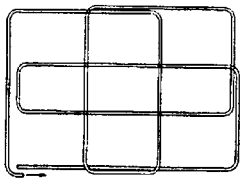
Figure 4e
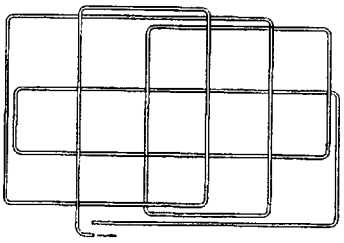
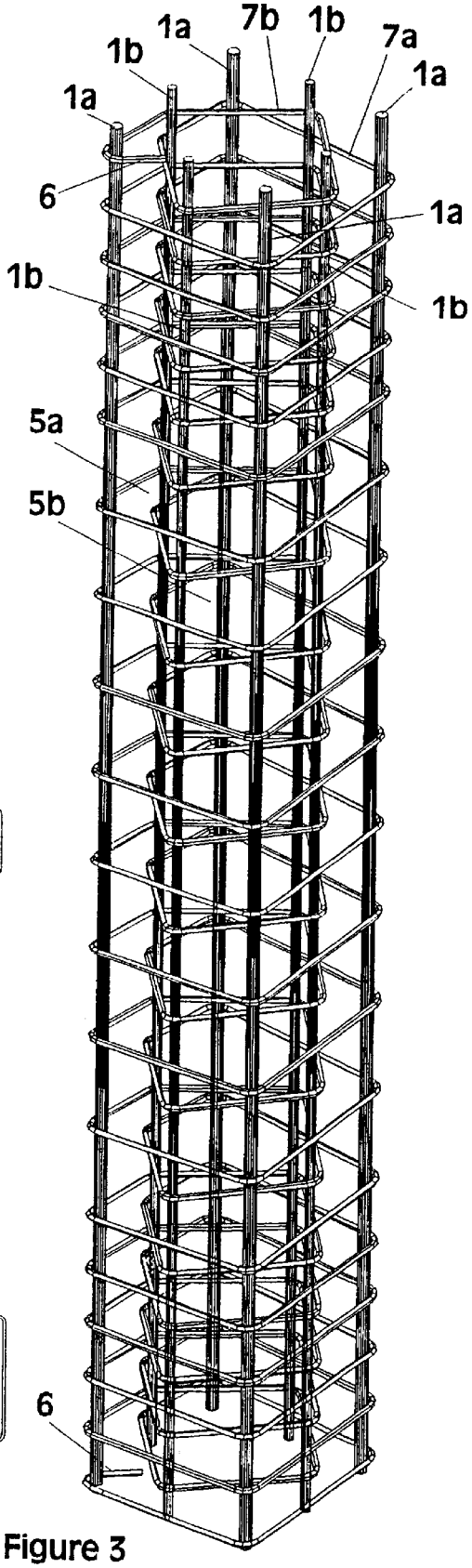
Figure 3

Figure 5a
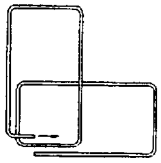
Figure 5b
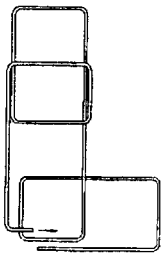
Figure 5c
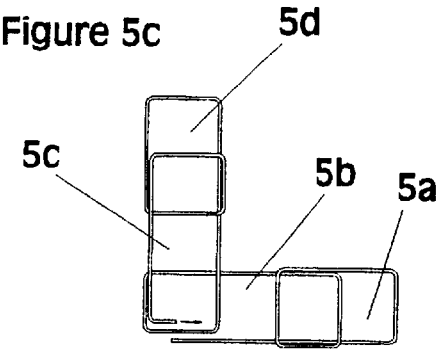
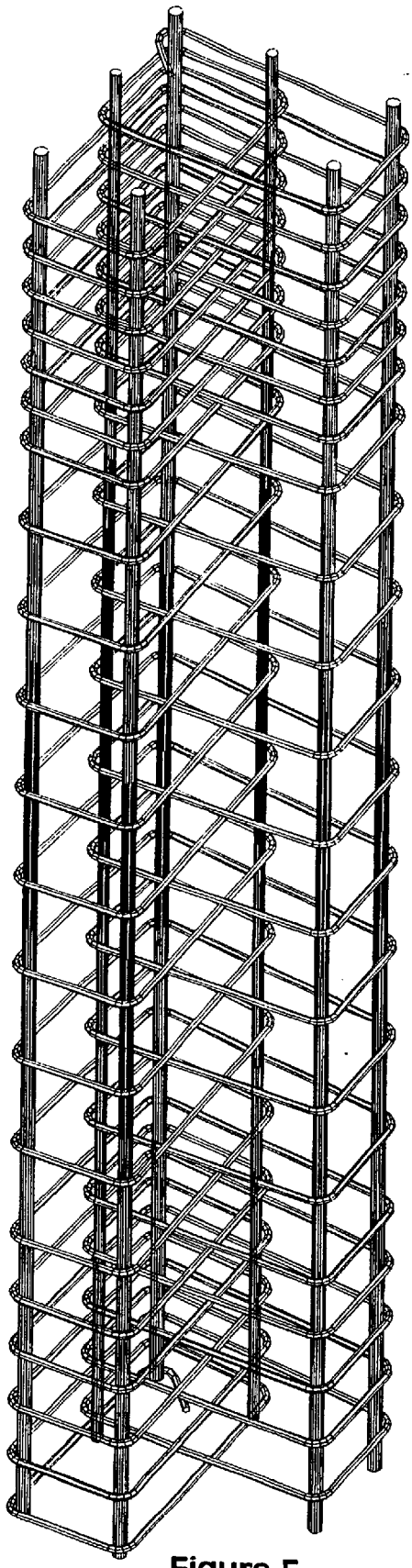
Figure 5

Figure 8
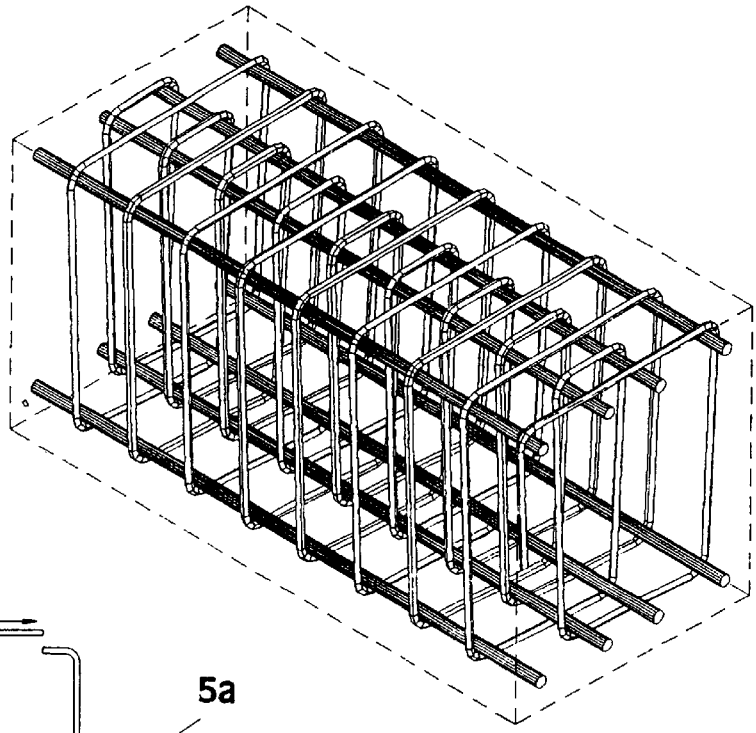
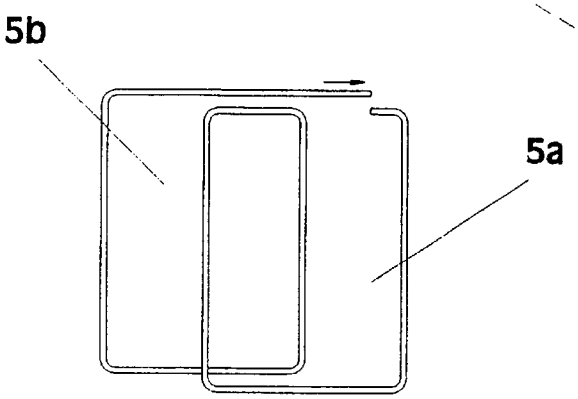
Figure 8a
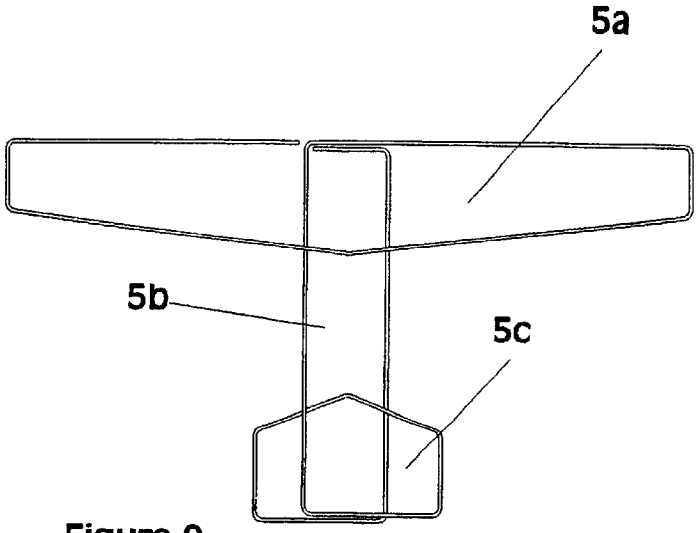
Figure 9

Figure 10a
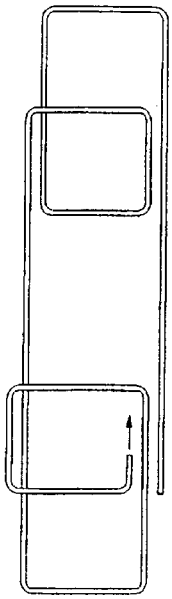
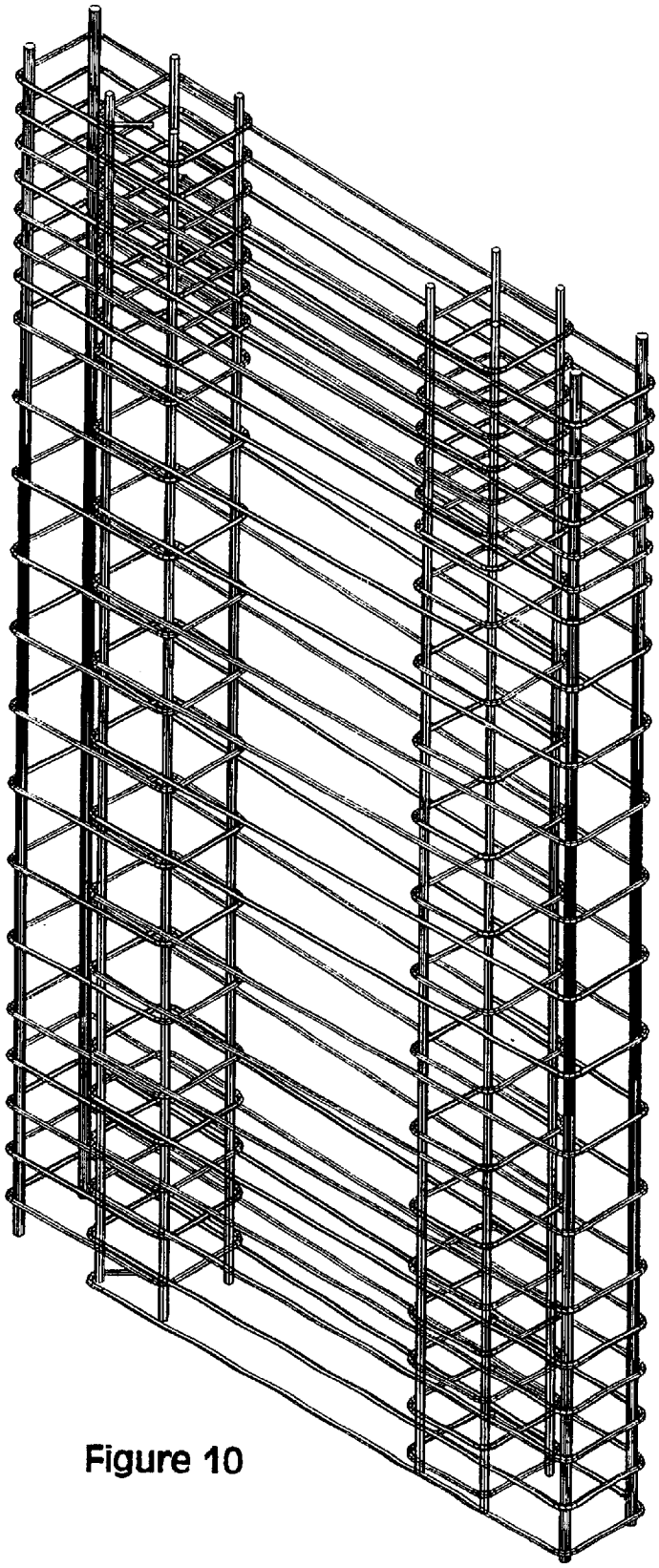
Figure 10

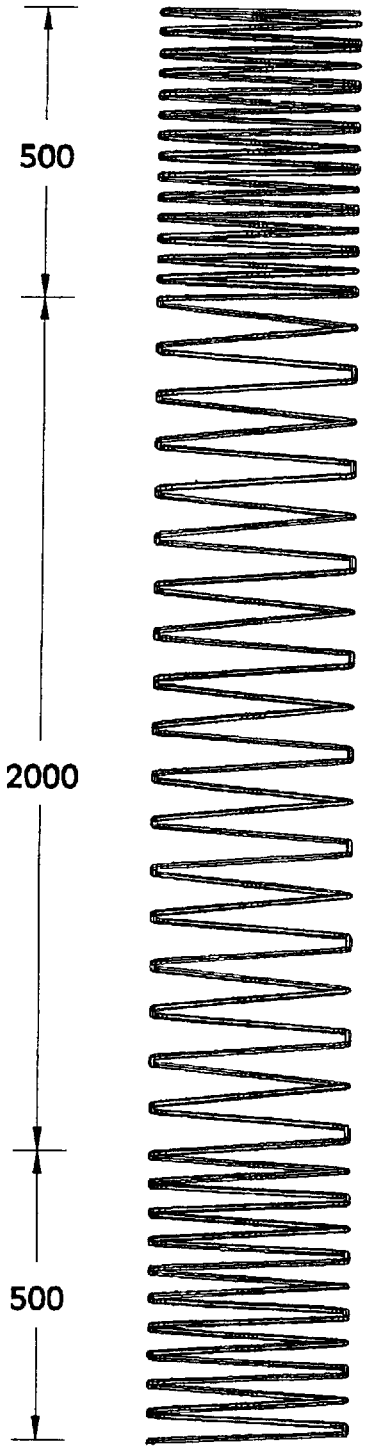
Figure 12
Figure 13a
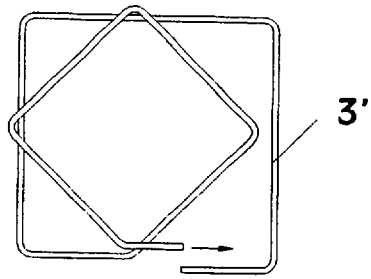
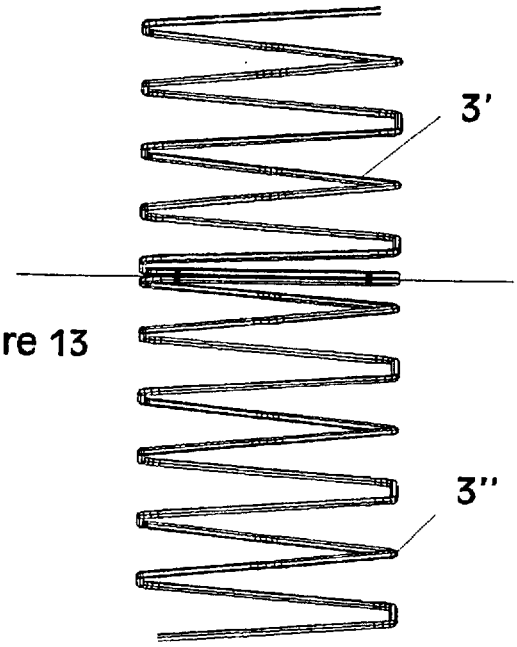
Figure 13
Figure 13b
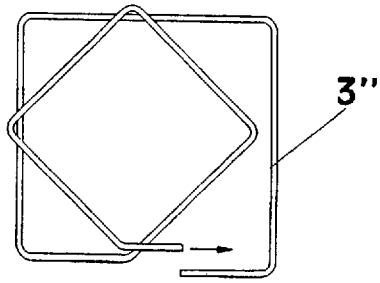

ANTISEISMIC SPIRAL STIRRUPS FOR REINFORCEMENT OF LOAD BEARING STRUCTURAL ELEMENTS

CROSS REFERENCE TO RELATED APPLICATIONS

This application is the national phase of International Application No. PCT/GR97/00043 filed on Dec. 31, 1997 and designating, inter atia, the United States. International Application No. PCT/GR97/00043 claims priority from Greek Patent Application No. 970100003 filed on Jan. 3, 1997.

BACKGROUND OF THE INVENTION

1. Field of the Invention

The present invention refers to stirrups for reinforcement of load bearing structural elements, and in particular for reinforcing concrete load bearing building elements, such as columns, shear walls, beams, slabs, footings, lintels, piles. The invention refers also to a method for reinforcing structural elements as well as to these elements.

2. Description of the Prior Art

Stirrups and ties constitute one of the most critical factors of quality and antiseismic strength of buildings. Essential factors for the liability of stirrups are the proper hooks at their ends and the bend diameter at corners. The hooks at the end of the conventional stirrups are absolutely necessary for ensuring the proper functioning of the stirrup or tie in case of a very strong earthquake, when the spalling of the concrete occurs and when the hooks is the only remaining anchorage mechanism.

The following stirrups are used in building industry today:

i) Individual stirrups 8, which may be of various forms, such as described in FIG. 1. For individual stirrups it is essential to be fastened in a plurality of points to the principal reinforcement rods 1 of the reinforcement as well as to the woodform. Thus their assembly is complicated and has a high cost. The individual stirrups 8 comprise hooks 6, for anchoring the stirrups to the load-bearing element of the structure.

ii) "Mantles", i.e. stirrup cages made of prefabricate welded meshes (see FIG. 2). These are made of standardised welded meshes in suitable machines. The partial replacement of common stirrups by the "mantles" or "stirrup cages" was the first attempt to transform the painful task of reinforcing the load bearing elements of the structure into an industrial process. However the manufacture of the mantles is done in two phases, and only part of the process may become an industrial one: The first phase is an industrial process aiming in the production of plane meshes, such as shown in FIG. 3, from steel rolls using huge machines. During the second phase the meshes are almost manually assembled to form stirrup cages. The production of "mantles" have the following limitations: a) it is difficult to manufacture compound stirrup shapes by analysing them in simple rectangular shapes, b) it is impossible to increase or decrease the spacing of the stirrups resulting in superfluous weight of the reinforcement, c) it is expensive to transport them due to the size of the cages, d) it is difficult to manufacture double hooks, which is a necessity in antiseismic structures, and e) there is a danger of buckling of the vertical binding bars in case of an earthquake.

iii) Circular or orthogonal spiral stirrups such as disclosed in EP-A-0152397. Numerous experiments have been executed with circular spirals, which proved that if the spacing of the windings, i.e. the pitch, is kept below a minimum distance, the spirals are actually functioning like steel closed mantles, whose strength is increased due to the presence of triaxial stress system. The spiral stirrups currently known are appropriate only for reinforcing columns with rectangular cross-section. Further they are uneconomical because of the constant spacing between windings, which is determined by the shear level at the most critical region of the member. They also present problems in manufacturing and difficulties in placing them by the skilled workmen, because of the excessive weight in cases of strongly reinforced columns with many sides.

SUMMARY OF THE INVENTION

An object of the present invention is a stirrup overcoming the problems of the known stirrups. A further object of the invention is a stirrup which may be used for reinforcing load bearing elements of various cross-sections such as columns, shear walls, beams, slabs, footings, lintels, piles.

An object of the invention is also a method for reinforcing the load bearing elements of a structure as well as such an element.

The stirrup for reinforcing load bearing elements, in accordance with the invention, comprises a plurality of consecutive windings disposed along the longitudinal direction of the stirrup and has a continuous cross-section, so that the stirrup has a spiral form, whereby the windings of the stirrup form a plurality of discrete cages for housing the main reinforcement rods of the load bearing element.

The method of reinforcing a load bearing element, according to the invention, comprising at least two sets of reinforcement rod elements, includes the step of providing a spiral shaped stirrup with a continuous cross-section and a plurality of consecutive windings, which windings form a plurality of cages, with each cage tightening a different set of reinforcement rod elements.

A load bearing element, according to the invention, comprises at least two sets of reinforcement rod elements and a spiral shaped stirrup with a continuous cross-section and a plurality of consecutive windings, which windings form a plurality of cages, with each cage tightening a different set of principal rod elements.

Stirrups in accordance with the invention have a spiral form, so that the axial load carried by the stirrup may continuously transmitted with no interruption along its length. The windings of the stirrups of the invention form more than one cages for the principal reinforcement rods, so that they may be used for the reinforcement of load bearing elements of various cross sections such as orthogonal, T-shaped, L-shaped, Z-shaped etc. The stirrup may be brought in site compressed, and stretched during its positioning around the principle reinforcement rods. Its attachment to the reinforcement rods requires a relatively low number of fastenings—it is enough to fasten each winding to four or even three principle reinforcement rods—and involves relatively a low cost. The use of the stirrups of the invention allows the manufacture of the transverse reinforcement, which is essential for antiseismic and other reasons, to become an industrial process with low manufacturing cost and high quality of the product.

Stirrups according to the invention may be manufactured from a steel grade with very high strength, for example S1200 (1200 MPa), because there is no need to use hooks for anchoring, which are usually the weak points of the known stirrups. A further advantage of the stirrups of the invention is that their production and the stirrups themselves, may be standardised so that they may be of high quality and they could be used for reinforcing standard types of load bearing elements.

The features of the invention described in the dependent claims offer further advantages.

BRIEF DESCRIPTION OF THE DRAWINGS

The invention will now be described by way of examples and with reference to the accompanying drawings in which:

FIG. 3 shows a stirrup according to the invention fastened to the principal reinforcement rods of a column and FIGS. 3*a* shows schematically this stirrup.

FIGS. 4*a*, 4*b*, 4*c*, 4*d*, 4*e* show schematically stirrups according to the invention for the reinforcement of columns.

FIGS. 5, 5*a*, 5*b*, 5*c*, 6, 6*a*, 6*b*, 6*c*, 6*d*, 6*e* and 7, 7*a* present spiral stirrups having L, T and cross-shaped cross-sections respectively FIGS. 8, 8*a*, 9 present spiral stirrups, adequate for footings or beams.

FIGS. 10, 10*a* present a spiral stirrup, adequate for a load-bearing wall.

FIGS. 12 present a spiral stirrup with variable pitch.

FIG. 13 shows a stirrup according to the invention consisting of two spiral elements shown in FIGS. 13*a* and 13*b*.

DESCRIPTION OF THE PREFERRED EMBODIMENTS

Referring to the attached drawings we shall describe some indicative examples of the antiseismic spirals according to the invention. These are spiral stirrups usually manufactured by robot machines, from coiled rods of $\phi 4$ to $\phi 16$ in steel rolls of every quality and grade. The use of the coiled rods provides the possibility to produce the stirrup in the shape of a spiral with no discontinuation, in one piece of compound shape. They are manufactured compressed and they are stretched with relative convenience during their placing. Stirrups according to the invention may be also made of composite materials, for example from glass fibres.

FIG. 3 shows a stirrup according to the invention. The spiral stirrup of this figure has consecutive alternating windings 7*a* and 7*b*. The set of windings 7*a* forms a cage 5*a* to house the principal rods 1*a* of the reinforcement. In use the windings 7*a* are tightened around the rods 1*a* and it could be enough to fasten each winding even to three rods. Similarly the set of windings 7*b* form a cage 5*b* to house the principal rods 1*b* of the reinforcement. Thus the stirrup includes two cages 5*a*, 5*b*, whereby each one of the cages 5*a*, 5*b* is formed by the alternating windings 7*a*, 7*b* respectively. The projections of windings 7*a* on a transverse plane coincide, so that the cage 5*a* is cylindrical or approximately cylindrical. Similarly cage 5*b* is cylindrical or approximately cylindrical, as the projection of the windings 7*b* on a transverse plane coincide. In the case of the stirrup of FIG. 4 the pitch is constant along the length of the stirrup, so that not only the projections of windings 7*a* coincide, but also the spatial shape of these windings is identical. The same applies for windings 7*b*.

FIG. 3*a* shows schematically a cross sectional view of the stirrup shown in FIG. 3, whereas FIGS. 4*a*, 4*b*, 4*c*, 4*d*, 4*e* show cross sectional views of other stirrups to be used for the reinforcement of columns. The stirrup of FIG. 4*a* has two cages 5*a*, 5*b* with overlapping cross sections, and FIG. 4*b* shows a stirrup with an almost rectangular cage 5*b* within a polygonal cage 5*a*. Such a stirrup may be formed with a circular or elliptical outer cage. Further stirrups for columns with rectangular cross-sections are shown in FIGS. 4*c*, 4*d* and 4*e*.

Figure 2:
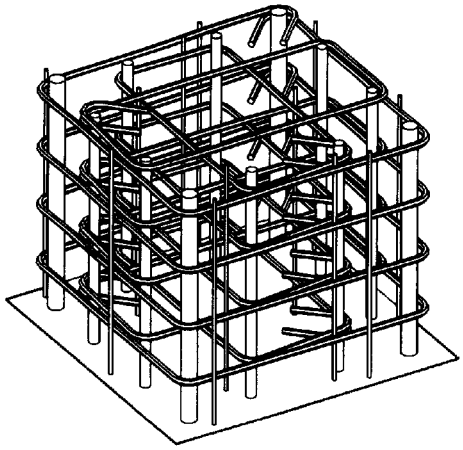
Figure 2 Prior Art
FIGS. 1, 2, 2*a* present the known stirrups.
Figure 2A:
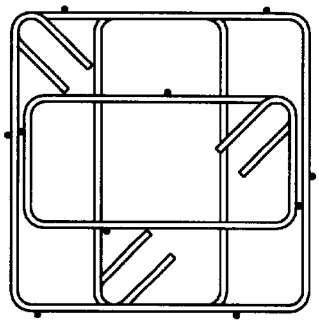
Figure 2a Prior Art
Figure 1:
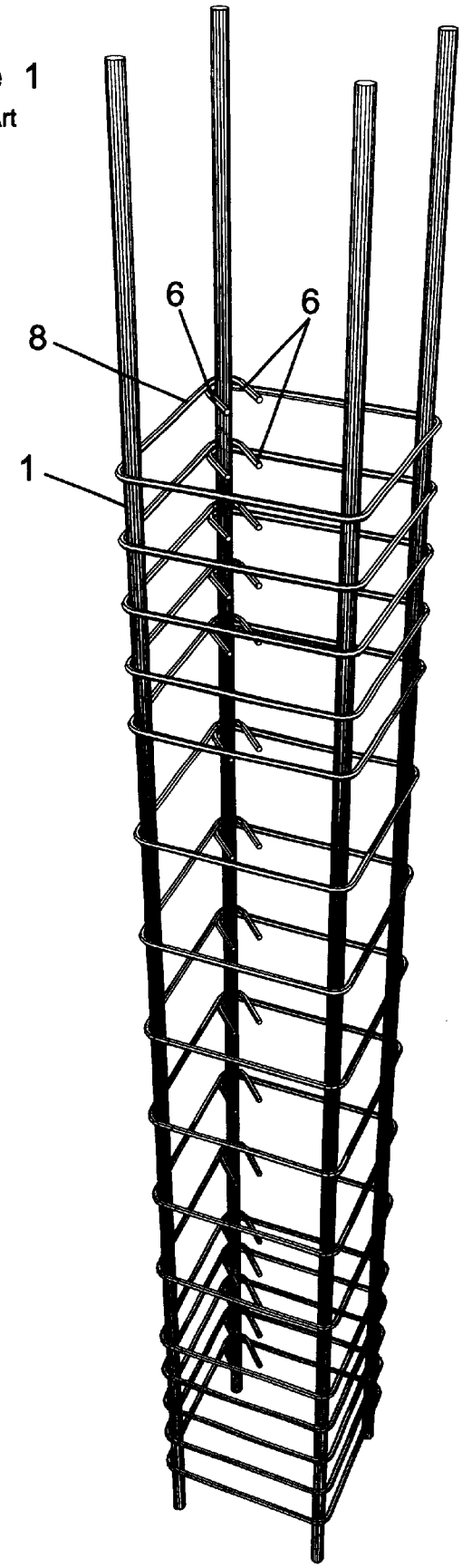
Figure 1 Prior Art
Figure 6A:
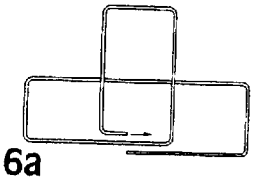
Figure 6B:
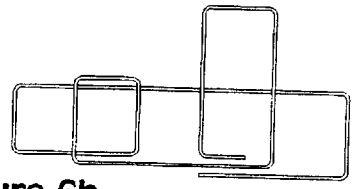
Figure 6C:
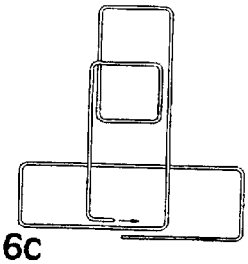
Figure 6D:
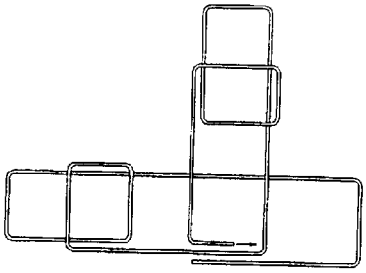
Figure 6E:
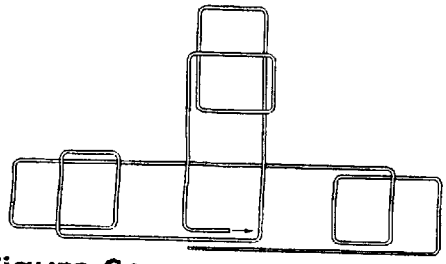
Figure 6:
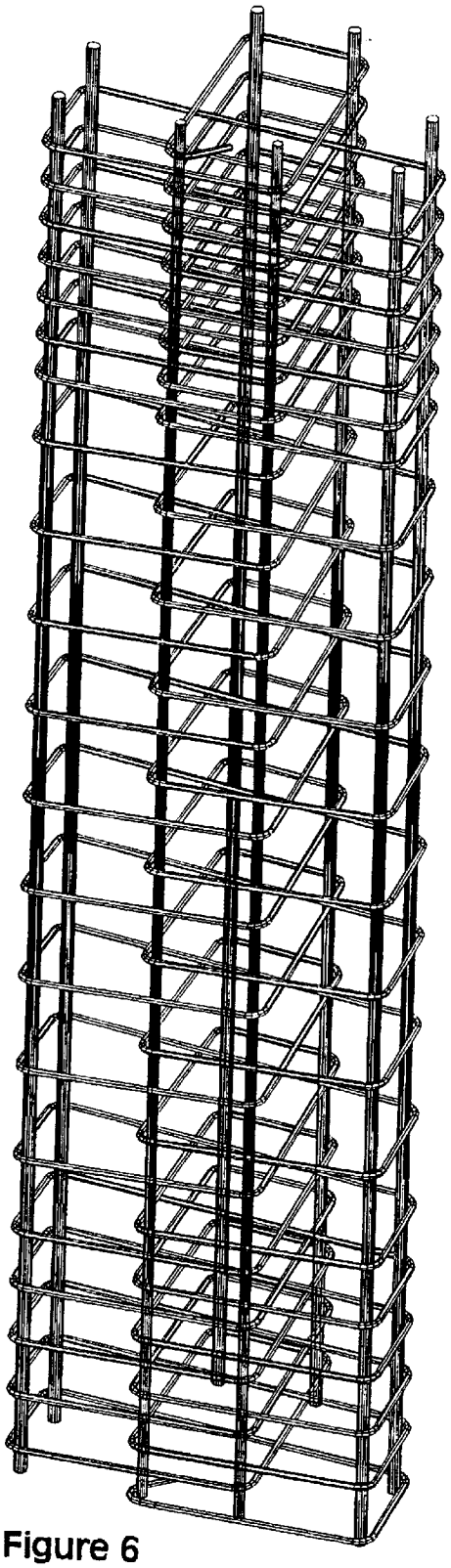
Figure 7A:
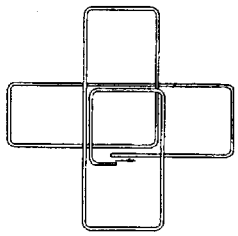
Figure 7:
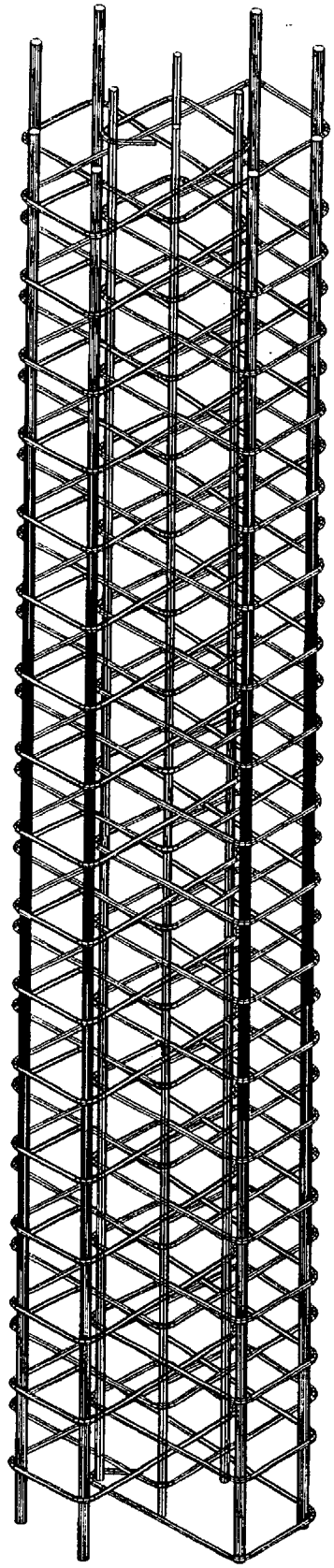
Figure 11A:
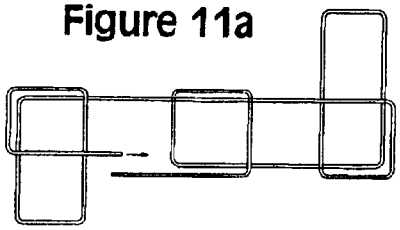
FIGS. 11*a*, 11*b*, 11*c*, 11*d*, 11*e*, 11*f* show stirrups according to the invention for the reinforcement of load bearing elements having a Z-shaped cross section.
Figure 11D:
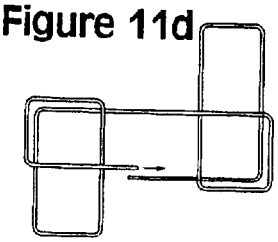
Figure 11B:
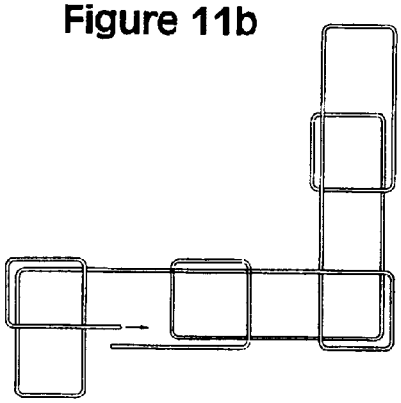
Figure 11E:
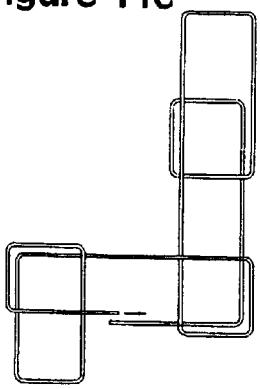
Figure 11C:
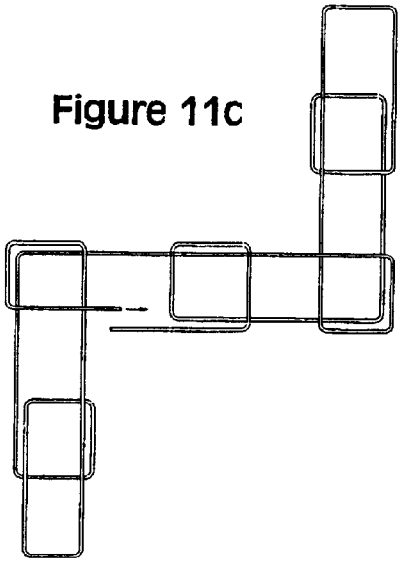
Figure 11F:
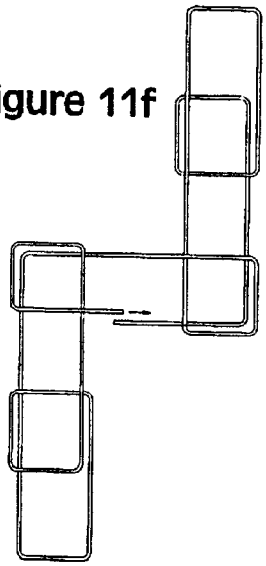
Figure 14:
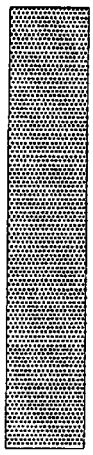
FIGS. 14*a*, 15*a*, 16*a*, 17*a* present a method of reinforcing load-bearing elements in accordance to the invention applied to the elements shown in FIGS. 14, 15, 16, and 17.
Figure 14A:
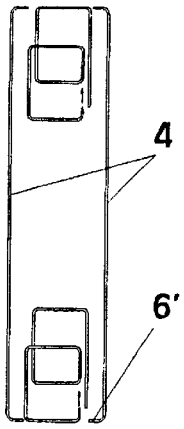
Figure 15:
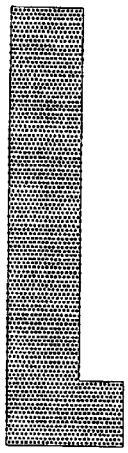
Figure 15A:
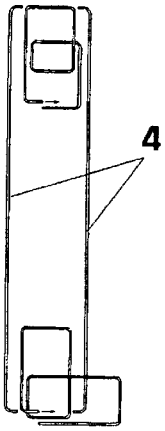
Figure 16A:
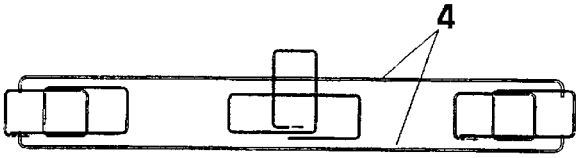
Figure 16:
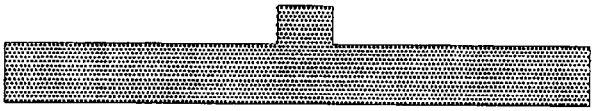
Figure 17:
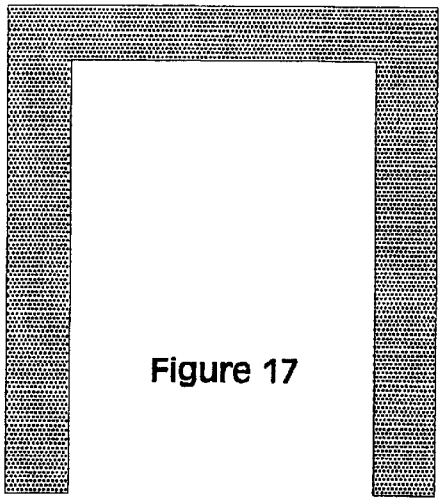
Figure 17A:
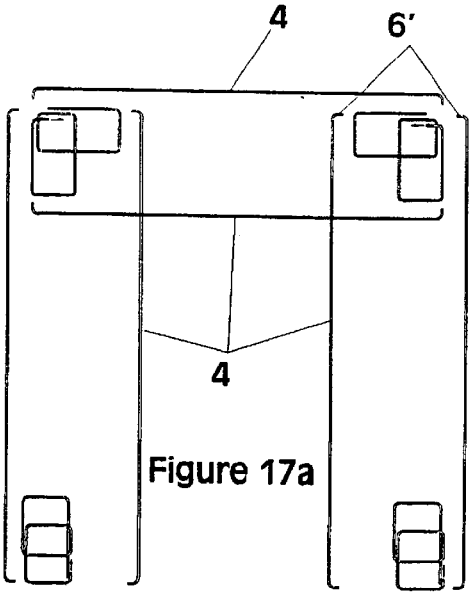

FIGS. 5, 5*a*, 5*b*, 5*c* present spiral stirrups having L-shaped cross-sections comprising two (see FIG. 5*a*), three (see FIG. 5*b*) or four (see FIG. 5*c*, cages 5*a*, 5*b*, 5*c*, 5*d*) cages. FIGS. 6, 6*a*, 6*b*, 6*c*, 6*d*, 6*e* present spiral stirrups with T-shaped cross sections, and FIGS. 7, 7*a* a stirrup with a cross-head cross-section. T-shaped spiral stirrups, which are also used for the reinforcement of footings, have an excellent performance when they carry simultaneously shear, torsional and flexural loads.

FIGS. 8, 8*a* show a spiral stirrup to be used for the reinforcement of a beam or footing, with two overlapping cages 5*a*, 5*b*, according the invention. With this arrangement a single spiral may be used for each footing or beam. FIG. 9 shows a spiral stirrup with three cages 5*a*, 5*b*, 5*c* to be used for the reinforcement of a beam of a bridge.

FIG. 10 shows the axonometric representation and plan view of a concrete shear wall with a spiral stirrup shown schematically in FIG. 10*a*.

FIGS. 11*a*, 11*b*, 11*c*, 11*d*, 11*e*, 11*f* show indicative representation of spirals for Z-shaped columns, which are often used at the corners of buildings.

With suitable programming of the production machine of the stirrup or appropriate fastening of the legs of the stirrup with the principal reinforcement rods, advancement of the windings along the length of the stirrup may be effected through longitudinal elements, while the windings remain at a substantial transverse plane. Such an option allows the use of the spirals in beam elements and footings that carry relatively high shear forces.

The pitch of the windings may be uniform or variable, as shown in FIG. 12. The variation in pitch may be effected either during production or during the reinforcing of the load-bearing element. With this arrangement the optimum economical solution arises because the variation of the pitch of the spiral may follow the shear forces diagram. FIG. 12 shows the spiral stirrup of FIG. 3, divided in parts with constant pitch. For example for a distance of 0.5 m in the base and 0.5 m in the top of the member the pitch equals to 10 cm and 12 cm respectively, whereas along the middle portion of the stirrup, which extends along a length of 2 meters, the pitch is 20 cm. This arrangement results in a highly efficient solution, since it strengthens the "critical regions" of the load-bearing element with shorter winding spacing. The stirrup of FIG. 12 may be used for the reinforcement of a column, beam or other structural elements.

The stirrup of the invention may be manufactured by a continuous extruded steel rod or by parts. With this arrangement the spiral is constructed by a number of spiral elements manufactured individually. The spiral elements may be constructed by rod with the same or different cross-section and may have the same or different pitch. In order to form the stirrup the spiral elements are placed side by side along their longitudinal direction and their ends are joint, so that one spiral element extends on one side of the joint and the other on the other side thereof. The joints may be effected in various ways: For example the two ends to be joint may be provided with hooks having an angle>=135°, and one spiral element may be fastened to the other through these hooks. Alternatively each end of the spiral elements is provided with a winding having a very small or even zero pitch which are welded together to effect the joint. Joint of the spiral elements may be also effected by the combination of the two previous arrangements. FIG. 13 shows a stirrup made of the two spiral elements 3', 3", shown schematically in FIGS. 13*a*, 13*b*, which is to be used for the reinforcement of beams, columns or other structural elements. The joint of spiral elements to produce a spiral with the features of the invention may be effected in site or it may be prefabricated.

FIGS. 14*a*, 15*a*, 16*a*, 17*a* show the application of spiral stirrups in accordance with the invention, for the reinforcement of the shear wall elements shown in FIGS. 14, 15, 16, and 17 respectively. The walls may be of large sizes and in general they may have a rectangular, angular, lift type etc. cross sections. In accordance with the method the combination of regular size spiral stirrups with longitudinal rods 4, which may have hooks 6'—90° or 135° or other angle—at their ends effects the reinforcement of the walls. Other ways of attachment of the rods to the stirrups are also possible. Spiral stirrups are placed at shear walls ends and they tied or welded to the longitudinal rods, which in the case of the examples shown in the figures, are normal or almost normal to the longitudinal direction of the stirrups. Although particular advantages are offered by this method of reinforcing when applied in combination with the spiral stirrups of the invention, other spiral stirrups may be also used.

The stirrups of the invention may be used for the reinforcement of prefabricated load bearing structural elements.

What is claimed is:

1. Stirrup for reinforcing load bearing elements having main reinforcement rods, whereby the stirrup comprises a plurality of consecutive windings (7*a*, 7*b*) disposed along the longitudinal direction of the stirrup and is made of a rod with a continuous cross-section, so that the stirrup has a spiral form, and whereby the windings of the stirrup form a plurality of discrete cages (5*a*, 5*b*) for housing the main reinforcement rods (1*a*, 1*b*) of the load bearing element.

2. Stirrup according to claim 1, whereby the stirrup comprises two cages to house the main reinforcement rods of the load bearing element.

3. Stirrup according to claim 1, whereby the stirrup comprises at least four cages (5*a*, 5*b*, 5*c*, 5*d*) to house the main reinforcement rods of the load bearing element.

4. Stirrup according to claim 1, whereby the shape of the windings on a transverse plane is orthogonal so that the projection of the stirrup on the transverse plane is T shaped.

5. Stirrup according to claim 1 whereby the stirrup comprises a plurality of cages and whereby one of the plurality of cages houses the other of the plurality of cages.

6. Stirrup according to claim 1, whereby the stirrup is made of a continuous extruded steel rod.

7. Stirrup according to claim 1, whereby the stirrup are made from composite material.

8. Stirrup according to claim 1, whereby the windings are disposed on substantially transverse planes and consecutive windings are joined by substantially longitudinal elements.

9. Stirrup according to claim 1, whereby the distance between consecutive windings is uniform.

10. Stirrup according to claim 1, whereby the distance between consecutive windings is variable.

11. A prefabricated load bearing element comprising a stirrup in accordance with any of the claims 1 to 10.

12. Method of reinforcing of shear wall elements using at least two of the stirrups of any of the claims 1 to 10.

13. Method of reinforcing a load bearing element comprising at least two sets of reinforcement rod elements, whereby the method includes the step of providing a spiral shaped stirrup made of a rod with a continuous cross-section and a plurality of consecutive windings, whereby the windings form a plurality of cages (5*a*, 5*b*), with each cage (5*a*, 5*b*) tightening a different set of reinforcement rod elements.

14. A load bearing element comprising at least two sets of reinforcement rod elements and a spiral shaped stirrup made of a rod with a continuous cross-section and a plurality of consecutive windings, whereby the windings form a plurality of cages (5*a*, 5*b*), with each cage (5*a*, 5*b*) tightening a different set of principal rod elements.

* * * * *

US006293071C1

(12) EX PARTE REEXAMINATION CERTIFICATE (6242nd)

United States Patent

Konstantinidis

(10) Number: US 6,293,071 C1

(45) Certificate Issued: Jun. 3, 2008

(54) ANTISEISMIC SPIRAL STIRRUPS FOR REINFORCEMENT OF LOAD BEARING STRUCTURAL ELEMENTS

(76) Inventor: Apostolos Konstantinidis, Alektoros 7, 116 32, Athens (GR)

Reexamination Request:
No. 90/007,511, Apr. 18, 2005

Reexamination Certificate for:

| | |
|---|---|
| Patent No.: | **6,293,071** |
| Issued: | **Sep. 25, 2001** |
| Appl. No.: | **09/331,805** |
| Filed: | **Jun. 25, 1999** |

(22) PCT Filed: Dec. 31, 1997

(86) PCT No.: PCT/GR97/00043

§ 371 (c)(1),
(2), (4) Date: Jun. 25, 1999

(87) PCT Pub. No.: WO98/29618

PCT Pub. Date: Jul. 9, 1998

(30) Foreign Application Priority Data

Jan. 3, 1997 (GR) ..... 970100003

(51) Int. Cl.
*E04C 5/06* (2006.01)

(52) U.S. Cl. ..... 52/659; 52/660; 52/745.17

(58) Field of Classification Search ..... None
See application file for complete search history.

(56) References Cited

U.S. PATENT DOCUMENTS

| | | | | |
|---|---|---|---|---|
| 4,461,232 A | | 7/1984 | Berg | |
| 4,617,219 A | * | 10/1986 | Schupack | 428/113 |
| 4,910,076 A | | 3/1990 | Ando et al. | |

FOREIGN PATENT DOCUMENTS

| | | |
|---|---|---|
| GR | 960200281 | 6/1996 |
| JP | 3151786 | 1/1993 |
| JP | 10152942 | 6/1998 |
| WO | WO 9324254 | 9/1993 |

OTHER PUBLICATIONS

Kellkoo Books Advertisement.*

*Proceedings of the Tenth World Conference on Earthquake Engineering,* Jul. 19, 1992, Pub. A.A. Balkema, citing *Development of a Specially Designed High Strength Transverse Reenforcement for Square Concrete Columns,* Masataka Shibata, eta al., pp. 3065–3070 [hereinafter Balkema], including 1 page letter dated Nov. 19, 1991 noting acceptance of paper by public body for oral presentation, and a subsequent letter dated Mar. 1992 noting a similar acceptance before the Madrid Jul. 1992 conference.

*High Strength Reinforcement for RC Columns,* M. Shibata et al., *Wire Industry,* Nov. 1992, pp. 744–746, [hereinafter Wire Industry].

*Effects of High Strength Transverse Reinforcement on the Ductile Behavior of Reinforced Concrete Members*—Development of Riverton Multi Spiral Hoops, Atsushi Nakasawa, et al., Kawasaki Steel Technical Report No. 28, Jun. 1993, Kawasaki Steel Corporation, pp. 56–64, [hereinafter Nakazawa].

(Continued)

*Primary Examiner*—Matthew C. Graham

(57) ABSTRACT

The present invention refers to stirrups for reinforcement of load bearing structural elements, and in particular for reinforcing concrete load bearing building elements, such as columns, shear walls, beams, slabs, footings, lintels, piles. The invention refers also to a method for reinforcing structural elements as well as to these elements. A stirrup for reinforcing load bearing elements according to the invention consists of a plurality of consecutive windings (7a, 7b) disposed along the longitudinal direction of the stirrup, so that the stirrup has a spiral form, whereby the windings of the stirrup form a plurality of discrete cages, (5a, 5b) to house the main reinforcement bars (1a, 1b) of the load bearing element. The stirrups may be used for the reinforcement of load bearing elements of various cross sections such as orthogonal, T-shaped, L-shaped, Z-shaped etc.

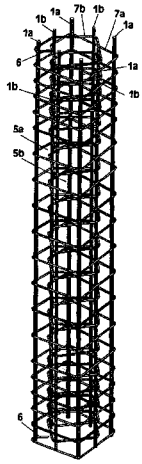

OTHER PUBLICATIONS

*Instructions for the Design and Installations and Explanations on the Segment of Ferro Concrete Which is Used for the Strong Corroborating Sections of Rods 'Riverbon',* Approved by the Minister of Constructions, Valuation by the Japanese Construction Center Published Feb. 1992, by Kawatetsu Technowire, pp. 1–37, Including Approval, Valuation, and Valuation Reports 12 pages total, [collectively hereinafter Kawatetsu], in Japanese with Full Translation.

Petition issued publically by the Ministry of Construction and Certificates, on Feb. 26, 1992, reviewing "*A Construction Method Using Deformed Prestressing Reinforcing Bar "Riverbon" as a Stirrup of Reinforced Concrete Beams or Columns,"* filed by Kawashaki Steel Techno–Wire Corp, President H. Mottate, (publically citing Evaluation Report and Certificates dated Nov. 20, 1991 and many other documents, See pp. 1–10 in English and pp. 1–11 in Japanese, including Evaluation Report p. 10 §2, noting that supporting documents were presented to the public committee supporting issuance of the report. Translation asserted by Y. Ishii, JP Patent Attorney, including Certificate of petition for approval, evaluation report, [hereinafter Kawasaki].

* cited by examiner

EX PARTE REEXAMINATION CERTIFICATE ISSUED UNDER 35 U.S.C. 307

THE PATENT IS HEREBY AMENDED AS INDICATED BELOW.

Matter enclosed in heavy brackets [ ] appeared in the patent, but has been deleted and is no longer a part of the patent; matter printed in italics indicates additions made to the patent.

AS A RESULT OF REEXAMINATION, IT HAS BEEN DETERMINED THAT:

The patentability of claim 4 is confirmed.

Claims 1–3 and 5–10 are cancelled.

Claims 11 and 12 are determined to be patentable as amended.

11. A prefabricated load bearing element comprising a stirrup in accordance with [any of the claims 1 to 10] *claim 4*.

12. Method of reinforcing of shear wall elements using at least two of the stirrups of [any of the claims 1 to 10] *claim 4*.

* * * * *